US011608629B2

(12) United States Patent
Mason

(10) Patent No.: US 11,608,629 B2
(45) Date of Patent: Mar. 21, 2023

(54) SUPPORT BRACKET

(71) Applicant: Illinois Tool Works Inc., Glenview, IL (US)

(72) Inventor: Greg Stephen Mason, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/292,624

(22) PCT Filed: Nov. 15, 2019

(86) PCT No.: PCT/US2019/061749
§ 371 (c)(1),
(2) Date: May 10, 2021

(87) PCT Pub. No.: WO2020/106578
PCT Pub. Date: May 28, 2020

(65) Prior Publication Data

US 2022/0010546 A1 Jan. 13, 2022

(30) Foreign Application Priority Data

Nov. 19, 2018 (AU) ..... 2018904425
Nov. 14, 2019 (AU) ..... 2019264633

(51) Int. Cl.
*E04B 1/41* (2006.01)
*E04B 1/38* (2006.01)

(52) U.S. Cl.
CPC ..... *E04B 1/4107* (2013.01); *E04B 2001/405* (2013.01)

(58) Field of Classification Search
CPC .. E04B 1/4107; E04B 1/483; E04B 2005/322; E04B 2005/324; E04B 2001/405; E04C 11/14
See application file for complete search history.

(56) References Cited

U.S. PATENT DOCUMENTS 2,094,853 A 10/1937 Shaw
2,181,005 A 11/1939 Westcott
(Continued)

FOREIGN PATENT DOCUMENTS

CA 2712305 7/2009
DE 3326174 A1 * 1/1984
(Continued)

OTHER PUBLICATIONS

Examination Report from Great Britain Application No. 2106802.8, dated May 10, 2022 (2 pages).
(Continued)

*Primary Examiner* — Theodore V Adamos
(74) *Attorney, Agent, or Firm* — Neal, Gerber & Eisenberg LLP

(57) ABSTRACT

A concrete pathway formwork system, including a formwork panel for forming adjacent concrete panels of a pathway, and a support bracket for supporting the system relative to a ground surface, wherein the formwork panel has a pair of vertically opposed longitudinal rails, and the support bracket has an engagement formation which has an unlocked orientation for inserting the formation between the opposed rails to abut against the formwork panel and a rotated, locked orientation wherein the formation is locked by the rails against lateral withdrawal from the formwork panel.

16 Claims, 16 Drawing Sheets

(56) References Cited

U.S. PATENT DOCUMENTS

| | | | | |
|---|---|---|---|---|
| 2,316,233 | A | 4/1943 | Fischer | |
| 2,349,983 | A | 5/1944 | Alexander | |
| 2,654,297 | A | 10/1953 | Nettleton | |
| 3,559,541 | A | 2/1971 | Watstein | |
| 4,733,513 | A | 3/1988 | Schrader et al. | |
| 4,942,912 | A | 7/1990 | Gakhar et al. | |
| 5,005,331 | A | 4/1991 | Shaw et al. | |
| 5,205,942 | A * | 4/1993 | Fitzgerald | E04G 17/04 249/47 |
| 5,216,862 | A | 6/1993 | Shaw et al. | |
| 5,261,635 | A * | 11/1993 | Flathau | B28B 23/00 249/7 |
| 5,458,433 | A | 10/1995 | Stastny | |
| 5,487,249 | A | 1/1996 | Shaw et al. | |
| 5,730,544 | A | 3/1998 | Dils et al. | |
| 5,830,378 | A * | 11/1998 | Butler | E04G 13/00 249/13 |
| 6,019,546 | A | 2/2000 | Ruiz | |
| 6,021,994 | A * | 2/2000 | Shartzer, Jr. | E04G 13/00 249/7 |
| 6,145,262 | A | 11/2000 | Schrader et al. | |
| 6,354,760 | B1 | 3/2002 | Boxall et al. | |
| 6,550,213 | B1 * | 4/2003 | Butler | E02D 27/02 249/34 |
| 6,629,681 | B1 * | 10/2003 | Miller | E01C 19/502 249/7 |
| 6,775,952 | B2 | 8/2004 | Boxall et al. | |
| 6,874,288 | B1 * | 4/2005 | Washa | E04G 13/062 52/155 |
| 6,926,463 | B2 | 8/2005 | Shaw et al. | |
| 7,228,666 | B2 | 6/2007 | Michiels | |
| 7,338,230 | B2 | 3/2008 | Shaw et al. | |
| 7,481,031 | B2 | 1/2009 | Boxall et al. | |
| 7,604,432 | B2 | 10/2009 | Shaw et al. | |
| 7,637,689 | B2 | 12/2009 | Boxall et al. | |
| 7,716,890 | B2 | 5/2010 | Boxall et al. | |
| 7,736,088 | B2 | 6/2010 | Boxall et al. | |
| 8,142,104 | B2 | 3/2012 | Connolly | |
| 8,302,359 | B2 | 11/2012 | Boxall et al. | |
| 8,303,210 | B2 | 11/2012 | Parkes et al. | |
| 8,356,955 | B2 | 1/2013 | Nadler | |
| 8,381,470 | B2 | 2/2013 | Boxall et al. | |
| 8,516,761 | B2 | 8/2013 | Laiho et al. | |
| 8,539,726 | B2 | 9/2013 | Laiho et al. | |
| 8,573,884 | B2 | 11/2013 | Nadler | |
| 8,627,626 | B2 | 1/2014 | Boxall et al. | |
| 9,260,867 | B2 | 2/2016 | Arnold | |
| 9,574,309 | B2 | 2/2017 | Mcdonald | |
| 9,637,874 | B2 * | 5/2017 | Ganey | E01C 19/4866 |
| 9,765,485 | B2 | 9/2017 | Keen | |
| 10,094,075 | B2 | 10/2018 | Keen | |
| 10,323,359 | B2 | 6/2019 | Meuwissen et al. | |
| 10,711,410 | B2 | 7/2020 | Meuwissen et al. | |
| 2003/0146365 | A1 * | 8/2003 | Miller | E04G 17/04 249/2 |
| 2006/0275078 | A1 | 12/2006 | Shaw et al. | |
| 2007/0269266 | A1 | 11/2007 | Kelly et al. | |
| 2010/0054858 | A1 | 3/2010 | Mayo et al. | |
| 2010/0086351 | A1 * | 4/2010 | Mercer | E04B 1/483 404/62 |
| 2012/0011800 | A1 * | 1/2012 | Moseid | E02D 27/013 52/741.15 |
| 2017/0009446 | A1 | 1/2017 | Eve | |
| 2018/0135297 | A1 | 5/2018 | Parkes et al. | |
| 2020/0325638 | A1 | 10/2020 | Murdoch et al. | |

FOREIGN PATENT DOCUMENTS

| | | | |
|---|---|---|---|
| DE | 102007020816 | 10/2008 | |
| FR | 3043105 | 5/2017 | |
| GB | 2285641 | 7/1995 | |
| GB | 2421049 | 6/2006 | |
| GB | 2467877 | 8/2010 | |
| GB | 2500626 | 10/2013 | |
| GB | 2511729 | 9/2014 | |
| GB | 2530344 | 3/2016 | |
| WO | WO 2004/065694 | 8/2004 | |
| WO | WO 2005/103412 | 11/2005 | |
| WO | WO 2005/111332 | 11/2005 | |
| WO | WO 2006/123176 | 11/2006 | |
| WO | WO 2009/153604 | 12/2009 | |
| WO | WO-2009153604 A1 * | 12/2009 | E01C 11/08 |
| WO | WO 2010/004294 | 1/2010 | |
| WO | WO 2013/076500 | 5/2013 | |
| WO | WO 2013/128151 | 9/2013 | |
| WO | WO 2014/060752 | 4/2014 | |
| WO | WO 2014/096980 | 6/2014 | |
| WO | WO 2014/111712 | 7/2014 | |
| WO | WO 2019/074632 | 4/2019 | |

OTHER PUBLICATIONS

Diamond Dowel® System Tapered Plate Dowels for Formed Construction Joints brochure , PNA Construction Technologies, available Nov. 19, 2018 (2 pages).

Diamond™ Dowel Load Transfer System Industrial Slab on Ground brochure, Danley™ Systems, available Nov. 19, 2018 (8 pages).

Load Transfer Systems Dowel Cradles Industrial Slab on Ground brochure, ITW Construction Systems and Danley Systems, available prior to Nov. 19, 2018 (12 pages).

International Search Report and Written Opinion from International Patent Application No. PCT/US2019/061749, dated Feb. 6, 2020 (11 pages).

* cited by examiner

SUPPORT BRACKET

PRIORITY

This application is a national stage application of PCT/US2019/061749, filed on Nov. 15, 2019, which claims priority to and the benefit of Australian Application No. 2018904425, filed Nov. 19, 2018, and Australian Application No. 2019264633, filed Nov. 14, 2019 the entire contents of each of which are incorporated herein by reference.

FIELD

The present disclosure relates to a formwork system and, more specifically, but not exclusively, to a formwork system for forming concrete panels of a floor, a road, a pathway, a footpath, a sidewalk, or the like.

BACKGROUND

It is known to use a plastic concrete shuttering system for forming concrete slabs or panels, such as in a floor, a road, a pathway, a footpath, a sidewalk, or the like. In particular, there is a concrete formwork system available under the trade mark "K-Form" that provides screed rails having a cross-sectional shape generally of an inverted T. However, the applicant has identified that such existing formwork systems often use metallic dowels that are sometimes prone to corrosion. The corrosion can sometimes lead to failure of the dowels resulting in adjacent panels no longer being kept level, or at least in deterioration of appearance where the corrosion becomes visible. Furthermore, the applicant has identified that it would be desirable for there to be provided a formwork system with improved cost-effectiveness.

Examples of the present disclosure seek to avoid or at least ameliorate one or more disadvantages of existing concrete formwork systems.

SUMMARY

In accordance with the present disclosure, there is provided a formwork panel for forming adjacent concrete panels of a floor, a road, a pathway, a footpath, a sidewalk, or the like (individually or collectively referred to herein as a pathway), and a support bracket for supporting the system relative to a ground surface, wherein the formwork panel has a pair of vertically opposed longitudinal rails, and the support bracket has an engagement formation that has an unlocked orientation for inserting the formation between the opposed rails to abut against the formwork panel and a rotated, locked orientation wherein the formation is locked by the rails against lateral withdrawal from the formwork panel.

In various embodiments, the formation is unlocked from the opposed rails by rotation of the formation about a lateral axis of the system from the locked orientation to the unlocked orientation.

In various embodiments, the bracket is supported relative to the ground surface by a stake, and the bracket has an aperture for receiving a stake.

In various embodiments, the stake is threaded. In various such embodiments, the threaded stake has opposed faces and the bracket is formed with rotationally spaced engagement portions such that the stake is able to be freely slid through the bracket and locked by rotating the stake about its longitudinal axis relative to the bracket.

In various embodiments, the bracket terminates above a lower edge of the formwork panel.

In various embodiments, the formwork panel is formed as a unitary part.

In various embodiments, the formwork panel has a pair of opposed sidewalls formed integrally with at least one rib, the opposed sidewalls defining a void therebetween.

In various embodiments, the bracket is formed as a unitary part.

In various embodiments, the bracket has a central rib extending along the length of the bracket.

There is also disclosed a dowel for controlling relative level between adjacent panels, wherein the dowel is formed of corrosion-free material so as to avoid corrosion of the dowel.

In various embodiments, the adjacent panels are concrete panels.

In various embodiments, the dowel is formed of material which is non-metallic.

In various embodiments, the dowel is formed of a polymer material.

In various embodiments, wherein the dowel is formed of a plastic material.

In various embodiments, the dowel is formed of a metal material portion covered in a polymer material portion. In various such embodiments, the polymer material portion seals within itself the metal material portion in an air-tight seal.

In various embodiments, the dowel is formed from material to avoid corrosion from oxidation of the dowel.

In various embodiments, the dowel is substantially planar. In various embodiments, the dowel is in the form of a plate.

In various embodiments, opposed edges of the dowel are tapered inwardly toward a central axis of the dowel, the central axis lying within a plane of the dowel. In various such embodiments, tapering of the opposed edges of the plate dowel is configured to allow, in situ, lateral movement between the adjacent concrete panels once the panels contract during drying of the concrete.

In various embodiments, the dowel has a cross-ribbed structure on an upper surface and on a lower surface to increase structural rigidity.

In various embodiments, the dowel has rounded corners. In various such embodiments, the rounded corners are radiused.

In various embodiments, the dowel has rounded edges. In various embodiments, the rounded edges are radiused.

In various embodiments, the dowel has a flange arranged to abut against a sideform through which the dowel is inserted. In various such embodiments, the flange extends in a plane perpendicular to the plane of the plate dowel. In various such embodiments, the flange is adapted to seal against the sideform so as to prevent ingress of concrete to a joint between adjacent concrete panels.

In various embodiments, the dowel is adapted for use in a non-industrial application.

In various embodiments, the dowel is adapted for being cast into a concrete pathway so as to transfer load between adjacent concrete panels of the pathway.

There is also disclosed a concrete pathway formwork system including a dowel for transferring load between adjacent concrete panels, wherein the dowel is a dowel as described above.

There is also disclosed a concrete pathway formwork system including a sideform for forming adjacent concrete panels of a pathway and a dowel adapted to extend through the sideform for transferring load between the adjacent concrete panels, wherein the dowel is a dowel as described above.

In various embodiments, the sideform is formed as a unitary panel having one or more ribs between opposed faces to facilitate crushing of the sideform in response to expansion of the concrete panels.

In various such embodiments, the sideform panel is substantially planar and arranged to extend perpendicular to a surface of the pathway.

There is also disclosed a sleeve for a dowel, wherein the sleeve is adapted to clip on to formwork through which the dowel is inserted.

In various embodiments, the sleeve includes a flange for abutting against the formwork, a sleeve portion extending from the flange, an upper rib supporting the sleeve portion relative to the flange and a lower rib supporting the sleeve portion relative to the flange. In various such embodiments, the flange includes an upper flange portion for engagement with an upper rail of the formwork and a lower flange portion having resilient clips for clipping behind a lower rail of the formwork.

In various such embodiments, the sleeve includes surrounds around the resilient clips preventing dislodgement of the upper flange portion from the upper rail of the formwork.

In various embodiments, the sleeve includes crushable internal lateral movement voids located at opposed sides of a cavity for receiving the dowel.

In various embodiments, the sleeve includes an expansion void.

In various embodiments, the sleeve portion includes internal ribs which provide interference on insertion of the dowel.

In various embodiments, the sleeve includes centering ribs which, when the sleeve is clipped on to the formwork, protrude into a dowel slot of the formwork to prevent lateral misalignment of the sleeve and the slot.

There is also disclosed a concrete pathway formwork system including a sideform for forming adjacent concrete panels of a pathway, a dowel adapted to extend through the sideform for transferring load between the adjacent concrete panels, and a sleeve for receiving the dowel, wherein the sleeve is adapted to clip on to the sideform.

There is also disclosed an articulating dowel system, including a dowel and a dowel sleeve, wherein the dowel includes a cam portion located within the sleeve to allow the dowel to pivot relative to the dowel sleeve.

In various embodiments, the cam portion has a forward rounded part to facilitate pivoting of the dowel relative to the dowel sleeve, and a rearward tapered part extending rearwardly and tapering inwardly from the rounded part to limit pivotal movement of the dowel relative to the dowel sleeve. In various such embodiments, the rounded part and the tapered part define a pivot with upper and lower stops to allow limited upward and downward pivoting of the dowel relative to the dowel sleeve.

In various embodiments, the dowel is formed from corrosion-free material.

In various embodiments, the sleeve is adapted to clip on to a sideform for forming adjacent concrete panels.

There is also disclosed a concrete pathway formwork system including a sideform for forming adjacent concrete panels of a pathway, a dowel adapted to extend through the sideform for transferring load between the adjacent concrete panels, and a sleeve for receiving the dowel, wherein the dowel is arranged to pivot upwardly and/or downwardly relative to the sleeve.

In various embodiments, the concrete pathway formwork system includes a seal fitted to the sideform, wherein the seal has an aperture through which a tongue of the dowel in inserted such that the seal operates to seal between the dowel and the sideform against concrete ingress.

There is also disclosed a formwork panel for forming adjacent concrete bodies, wherein the formwork panel is adapted to be compressible on expansion of the concrete bodies.

In various embodiments, the formwork panel is substantially planar. In various such embodiments, the formwork panel is substantially planar to be in a plane substantially perpendicular to a travel surface formed by upper surfaces of the concrete bodies.

In various embodiments, the formwork panel is extruded.

In various embodiments, the formwork panel has at least one internal void to facilitate sacrificial compression of the formwork panel on expansion of the concrete bodies.

In various embodiments, the formwork panel has a pair of opposed sideform walls connected by at least one sacrificial rib defining an internal void between the opposed sideform walls.

In various embodiments, the formwork panel has a pair of opposed rails along at least one side of the formwork panel, the opposed rails defining a channel for slideable mounting of an accessory to the formwork panel. In various such embodiments, the channel enables the formwork panel to be connected to another like formwork panel by inserting one end of a joiner plate in the channel the formwork panel and an opposite end of the joiner plate in the channel of the like formwork panel.

In various embodiments, the formwork panel has a constant cross-sectional shape along its length and is able to be cut to length accordingly.

In various embodiments, the formwork panel has an upper capping, the capping having sidewalls and a top surface arranged to be level with upper surfaces of the concrete bodies.

There is also disclosed a formwork panel for forming adjacent concrete bodies, the formwork panel having a formwork panel body and a formwork panel capping arranged to be selectively moved from a coupled condition in which the formwork panel capping is coupled to the formwork panel body to form a surface level with upper surfaces of the concrete bodies and a decoupled condition in which at least part of the formwork panel capping is decoupled from the formwork panel body so as to form a well between the concrete bodies.

In various embodiments, the well has a predetermined depth.

In various embodiments, the formwork capping is formed with a frangible part which is torn to move the formwork panel capping from the coupled condition to the decoupled condition. In various such embodiments, the frangible part is located between an upper portion of the capping and a lower portion of the capping such that tearing the frangible part separates the upper portion of the capping from the lower portion of the capping.

In various embodiments, the capping includes opposed arms extending laterally outwardly from opposite sides of the capping such that distal ends of the arms are embedded in the concrete bodies. In various such embodiments, each of the distal ends has an enlarged portion to facilitate retainment in the concrete.

In various embodiments, the opposed arms extend outwardly from the lower portion of the capping.

In various embodiments, the arms are able to be stretched to accommodate relative outward movement/retraction of the concrete bodies.

BRIEF DESCRIPTION OF THE DRAWINGS

Various embodiments of the present disclosure will be described, by way of non-limiting example only, with reference to the accompanying drawings in which.

DETAILED DESCRIPTION

With reference to FIGS. 1 to 6, there is shown a dowel 10 for controlling relative level between adjacent concrete panels, such that one concrete panel of a pathway or the like will stay level with a neighbouring concrete panel so as to maintain a level path and to avoid a tripping or other hazard. In various embodiments, the dowel 10 is formed of corrosion-free material so as to avoid corrosion of the dowel 10.

The adjacent panels being kept level by the dowel 10 are formed of concrete, however it is possible that the dowel 10 and associated formwork system may be used for maintaining a level between panels cast from a different material. As shown in FIGS. 1 to 6, the dowel 10 is formed from material that is non-metallic and is preferably formed of a polymer material or other plastic material that is not prone to corrosion as are typical metal dowels. In one particular form, the dowel 10 may be formed of a metal material portion covered in a polymer material portion. In that case, the polymer material portion seals within itself the metal material portion in an air-tight seal so as to protect the metal material portion from corrosion from oxidation.

Figure 1:
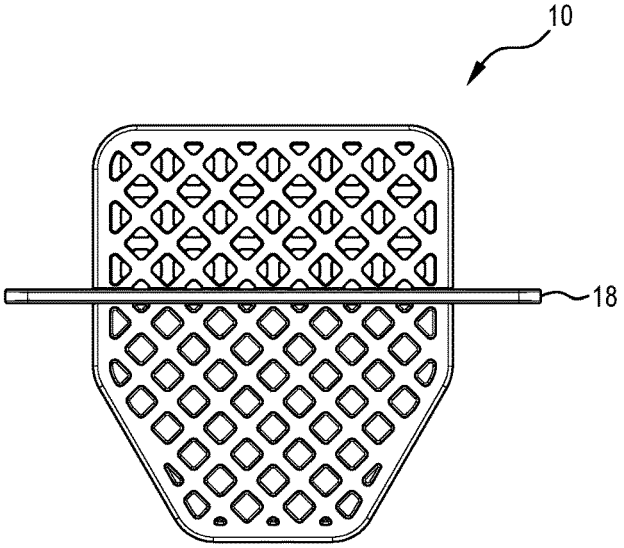
FIG. 1 shows a top view of a dowel of one example embodiment of the present disclosure.
Figure 2:
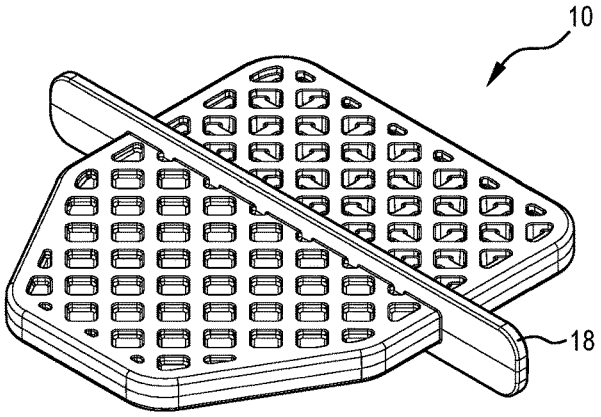
FIG. 2 shows a perspective view of the dowel of FIG. 1.
Figure 3:
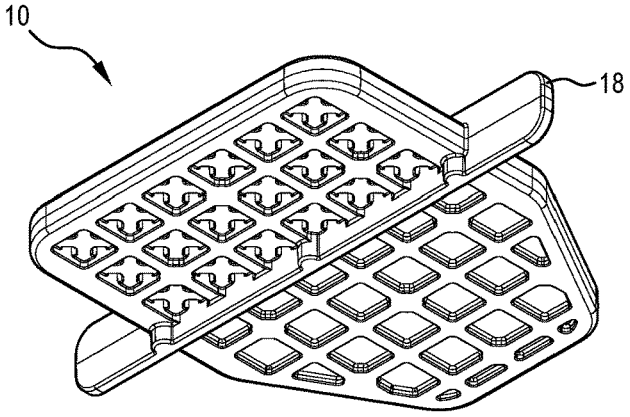
FIG. 3 shows an opposite side perspective view of the dowel of FIG. 1.
Figure 3A:
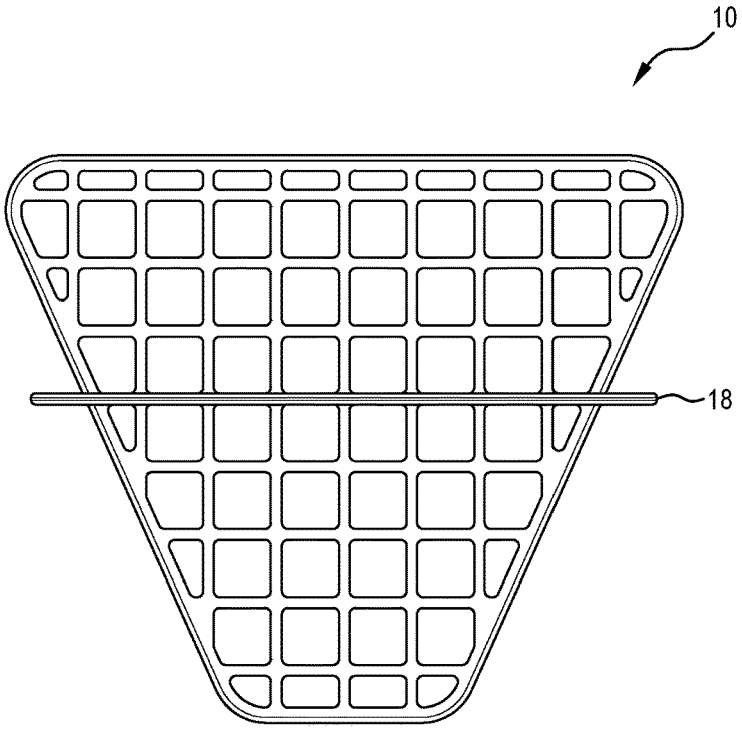
FIGS. 3*a*, 3*b*, and 3*c* show top and perspective views of alternative dowels having a different shape in accordance with the present disclosure.
Figure 3B:
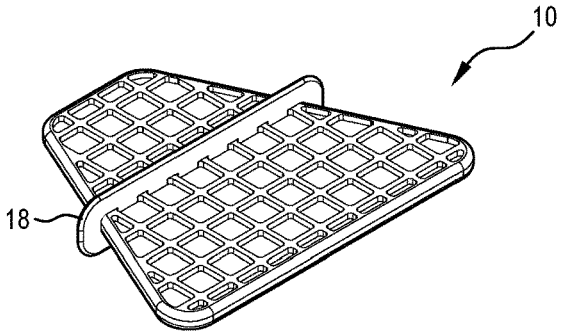
Figure 3C:
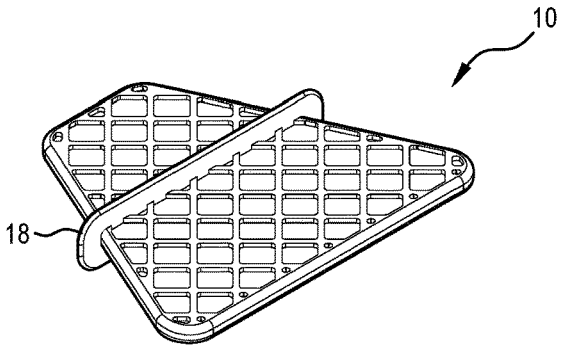

FIGS. 3*a* to 3*c* show top and perspective views of alternative dowels 10 having a different shape. Whereas the dowel 10 shown in FIGS. 1 to 3 is in the form of a six-sided shape (being rectangular at one side of the flange 18 and having a tapered portion at the other side of the flange), the dowels 10 shown in FIGS. 3*a* to 3*c* are four-sided. More specifically, the four-sided dowels 10 of FIGS. 3*a* to 3*c* have front and rear sides that are mutually parallel, as well as left and right sides that taper at the same angle on both sides of the flange 18.

Figure 4:
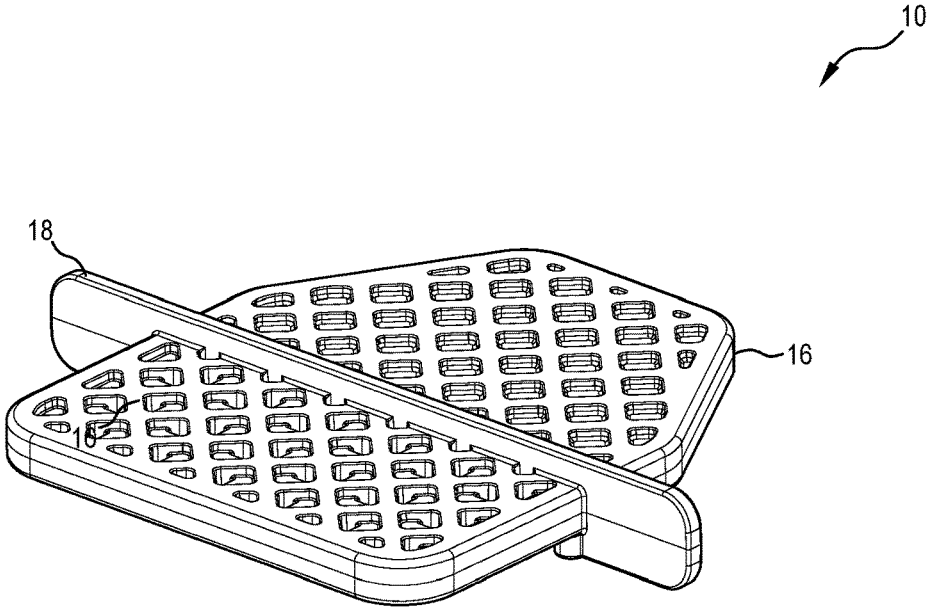
FIG. 4 shows bottom detail of a corrosion-free plate dowel of FIG. 1.
Figure 5:
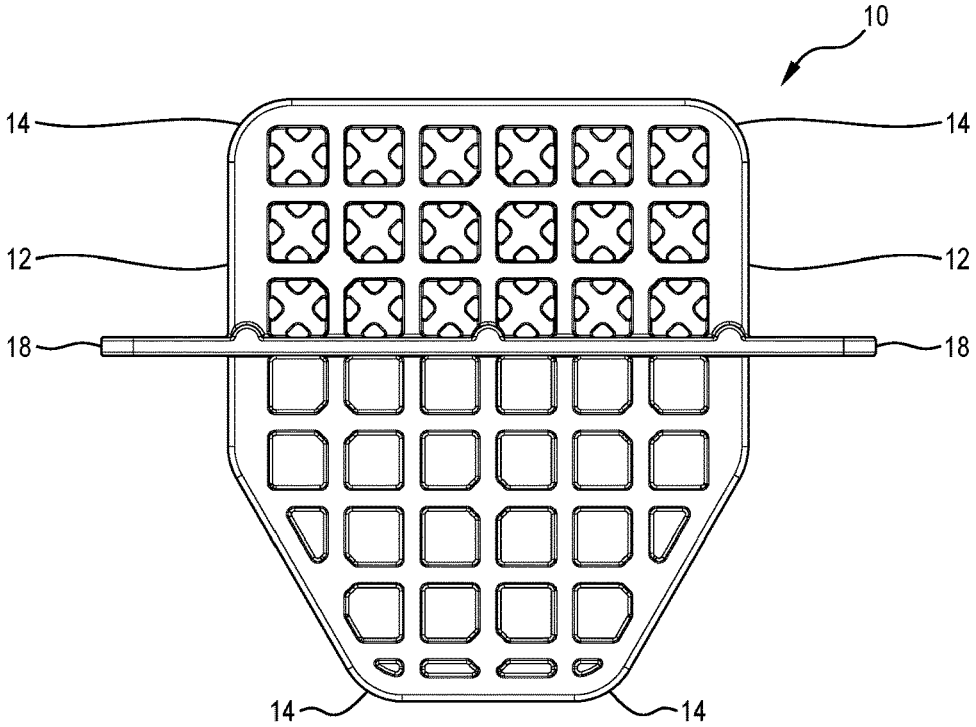
FIG. 5 shows a top plan view of the cross rib structure of the dowel of FIG. 1.

As can be seen in FIGS. 4 and 5, the dowel 10 is substantially planar and is generally in the form of a plate. Opposed edges 12 of the dowel 10 are tapered inwardly toward a central axis of the dowel 10, the central axis lying within a plane of the dowel 10, the central axis lying along the central vertical rib shown in the orientation of FIG. 5. Tapering of the opposed edges 12 of the plate dowel 10 is configured to allow, in situ, lateral movement between the adjacent concrete panels when the concrete panels contract during drying of the concrete. The dowel 10 may have a cross-ribbed structure on an upper surface and on a lower surface to increase structural rigidity.

As shown in FIG. 5, the dowel 10 may have rounded corners 14 that may be radiused. The dowel 10 may also have rounded edges 16 (see FIG. 4) that may be radiused.

Figure 6:
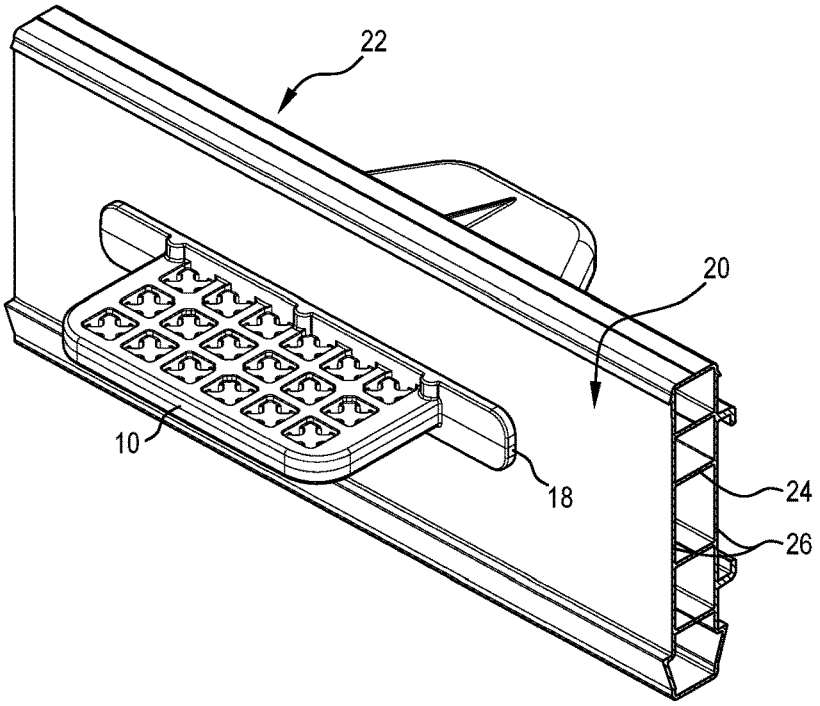
FIG. 6 shows a sealing flange of the dowel of FIG. 1 when used to seal against a sideform of one example embodiment of the present disclosure.

The dowel 10 may have a flange 18 arranged to abut against a sideform 20 (as seen in FIG. 6) through which the dowel 10 is inserted. The flange 18 extends in a plane perpendicular to the plane of the plate dowel 10. The flange 18 is adapted to seal against the sideform 20 so as to prevent ingress of concrete to a joint between adjacent concrete panels.

The dowel may be adapted for use in a non-industrial application and may be adapted for being cast into a concrete pathway so as to transfer load between adjacent concrete panels of the pathway.

Accordingly, there is disclosed a corrosion-free tapered plate dowel load transfer system. The tapered plate dowel provides lateral movement once the joint contracts. The double-sided cross-ribbed structure provides increased structural rigidity (providing increased bending strength) by breaking up un-reinforced horizontal surfaces. Corners and edges are radiused to prevent point loads giving even distributed forces at the dowel perimeter. The flange 18 on the dowel 0 acts as a seal preventing concrete ingress into the joint. The flange 18 may optionally incorporate a rubber seal (not shown) to facilitate the sealing effect.

With reference to FIG. 6, there is shown a concrete pathway formwork system 22 including a sideform 20 for forming adjacent concrete panels of a pathway and a dowel 10 adapted to extend through the sideform 20 for transferring load between the adjacent concrete panels, wherein the dowel is formed of corrosion-free material. The sideform 20 is formed as a unitary panel having one or more ribs 24 between opposed faces 26 to facilitate crushing of the sideform 20 in response to expansion of the concrete panels.

Figure 7:
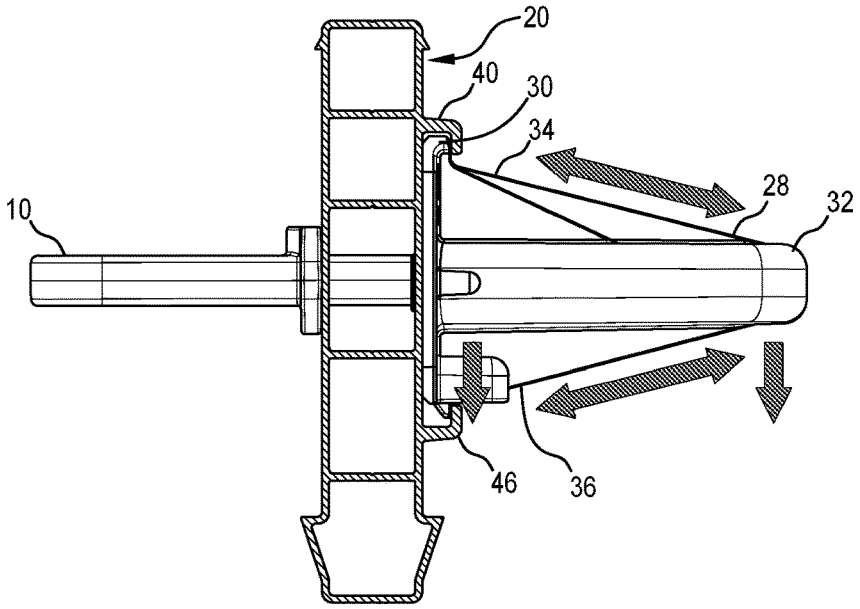
FIG. 7 shows a side view of a clip-on cantilevered plate dowel sleeve of one example embodiment of the present disclosure.
Figure 8:
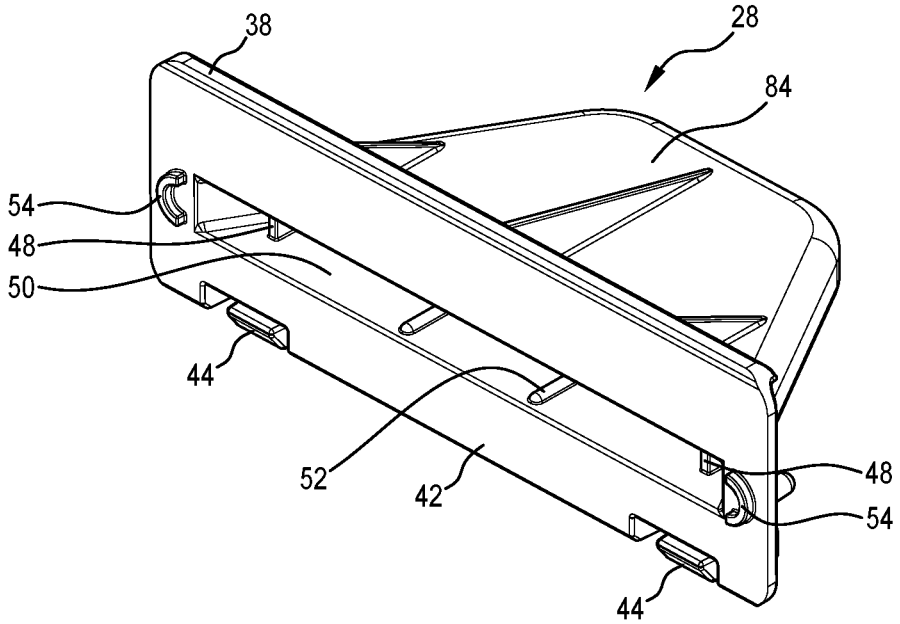
FIG. 8 shows a perspective view of the sleeve of FIG. 7.
Figure 9:
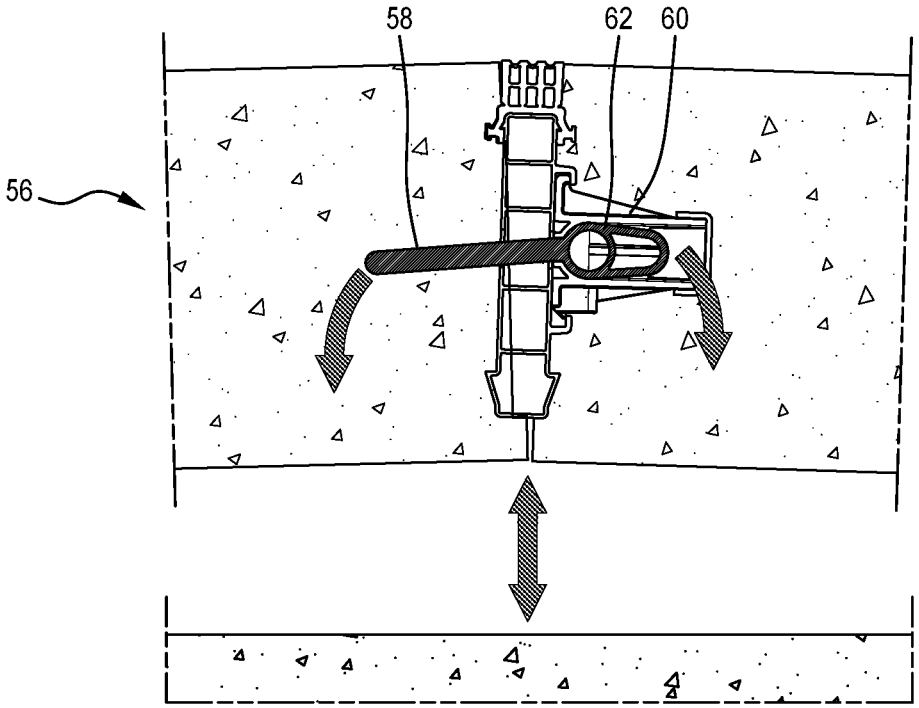
FIG. 9 shows a side cutaway view of an articulating dowel system of one example embodiment of the present disclosure.

With reference to FIGS. 7 and 8, there is shown a sleeve 28 for a dowel 10, wherein the sleeve 28 is adapted to clip on to formwork 20 through which the dowel 10 is inserted. With reference to FIG. 7, the sleeve 28 includes a flange 30 for abutting against the formwork 20, a sleeve portion 32 extending from the flange 30, an upper rib 34 supporting the sleeve portion 32 relative to the flange 30 and a lower rib 36 supporting the sleeve portion 32 relative to the flange 30. The flange 30 includes an upper flange portion 38 for engagement with an upper rail 40 of the formwork 20 and a lower flange portion 42 having resilient clips 44 for clipping behind a lower rail 46 of the formwork 20.

The sleeve 28 may include surrounds around the resilient clips 44 preventing dislodgement of the upper flange portion 38 from the upper rail 40 of the formwork 20. The sleeve 28 may include crushable internal lateral movement voids 48 located at opposed sides of a cavity 50 for receiving the dowel 10. The sleeve 28 may include an expansion void and the sleeve portion 32 may include internal ribs 52 that provide interference on insertion of the dowel 10. The sleeve 28 includes centering ribs 54 which, when the sleeve 28 is clipped on to the formwork 20, protrude into a dowel slot defined by the formwork 20 to prevent lateral misalignment of the sleeve 28 from the slot.

Accordingly, there is shown a concrete pathway formwork system 22 including a sideform 20 for forming adjacent concrete panels of a pathway, a dowel 10 adapted to extend through the sideform 20 for transferring loads between the adjacent concrete panels, and a sleeve 28 for receiving the dowel 10, wherein the sleeve 28 is adapted to clip on to the sideform 20.

It should be appreciated that various such embodiments of the present disclosure provide one or more of the following features or advantages:

- A fastener-less pivoting clip on function for extruded formwork.
- Resisting sleeve pull down by bracing itself above sleeve body with locked in cantilevered ribs.
- Ribs below the sleeve brace sleeve in compression.
- Surrounds around the clips that prevent sleeve dislodgement from top pivoting point.
- Incorporating 5 mm crushable internal lateral movement voids and a 10 mm expansion void.
- Corners and edges radiused to prevent point loads giving even distributed forces at the sleeve perimeter.
- Internal ribs providing interference to the plate dowel upon insertion to prevent accidental pull-out during concrete pouring.
- Centring ribs protruding into the slot on formwork preventing lateral misalignment of the sleeve with the slot.

With reference to FIGS. 9 to 12, there is also disclosed an articulating dowel system 56, including a dowel 58 and a dowel sleeve 60, wherein the dowel 58 includes a cam portion 62 located within the sleeve 60 to allow the dowel 58 to pivot relative to the dowel sleeve 60.

Figure 10:
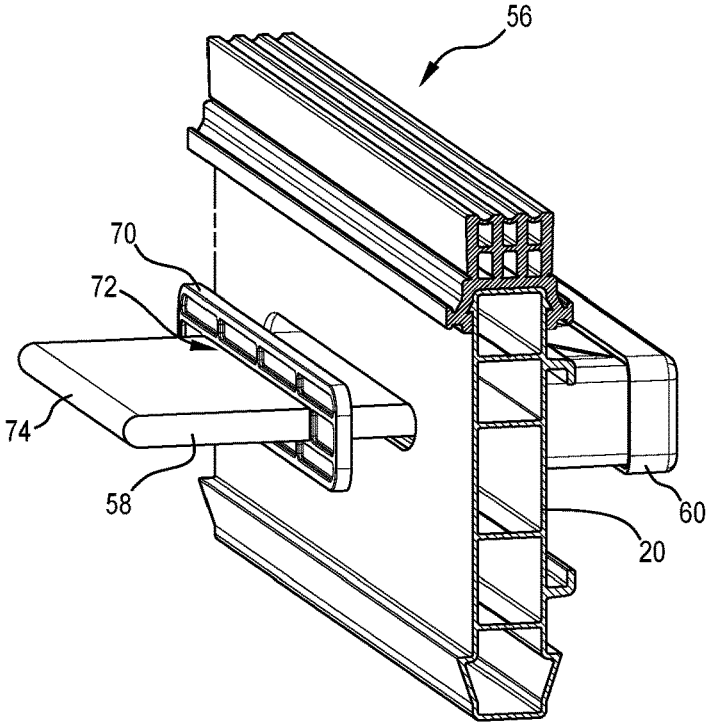
FIG. 10 shows a perspective view of the articulating dowel system of FIG. 9.
Figure 11:
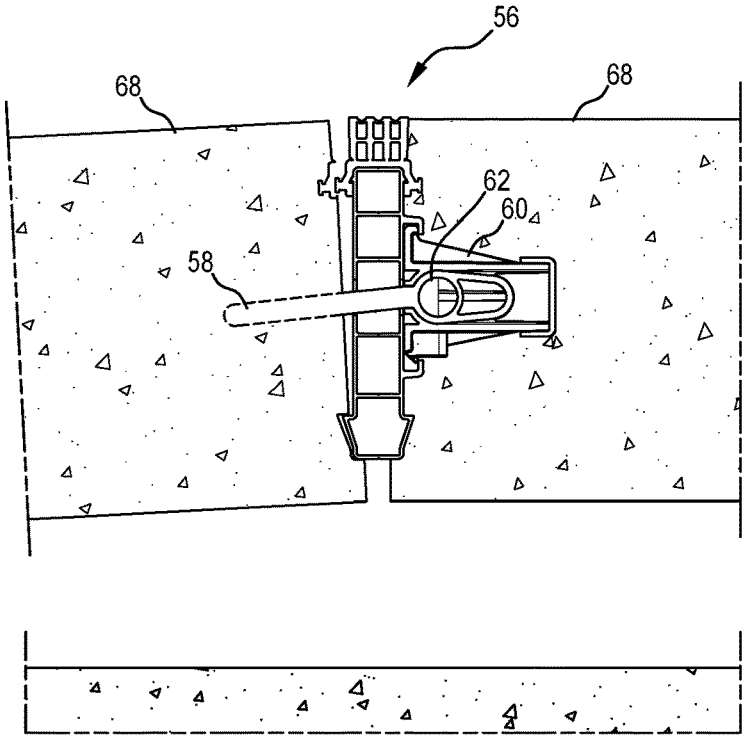
FIG. 11 shows a side cross-sectional view of an articulating dowel system of FIG. 9 with a 50 mm vertical lift.
Figure 12:
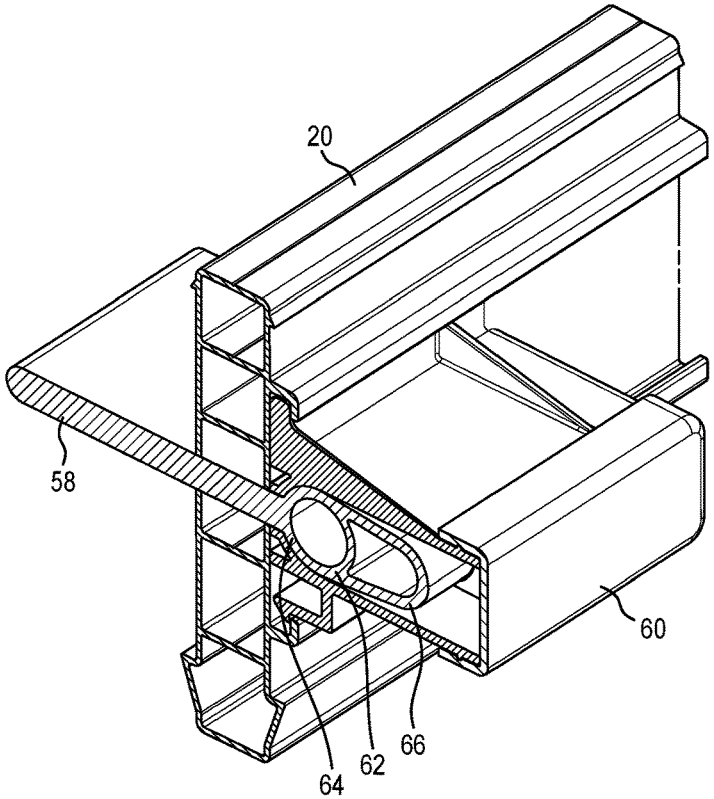
FIG. 12 shows a cam component of the articulating dowel system of FIG. 9.
Figure 13:
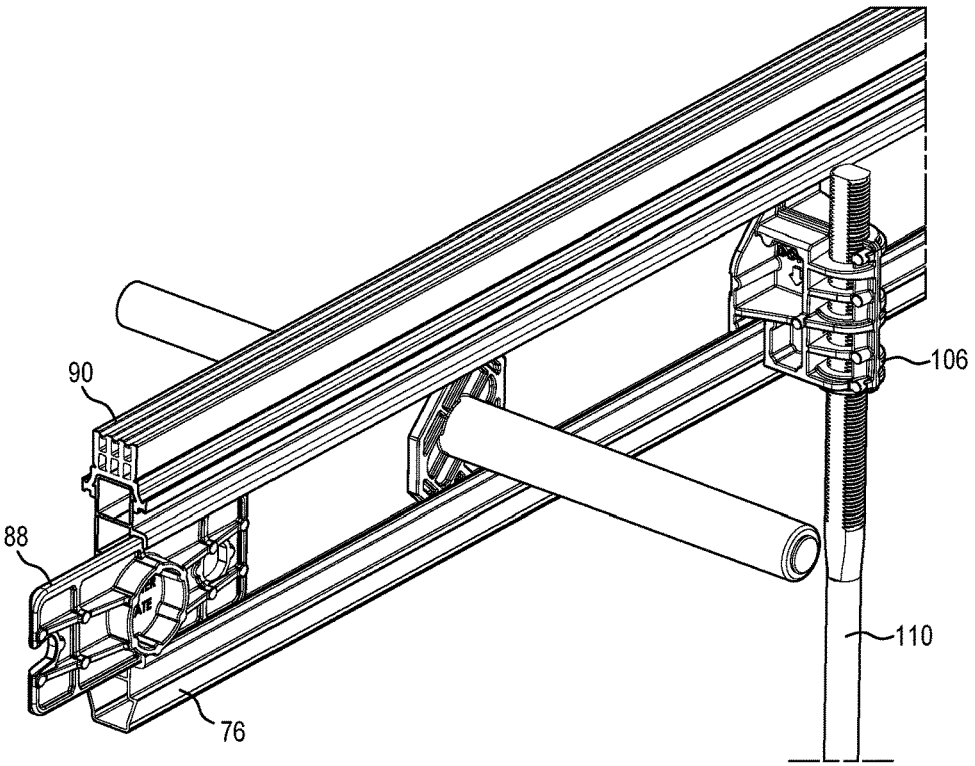
FIG. 13 shows a perspective view of a multi-functional formwork panel of one example embodiment of the present disclosure.

The cam portion 62 has a forward rounded part 64 (as seen in FIG. 12) to facilitate pivoting of the dowel 58 relative to the dowel sleeve 60, and a rearward tapered part 66 extending rearwardly and tapering inwardly from the rounded part 64 to limit pivotal movement of the dowel 58 relative to the dowel sleeve 60. The rounded part 64 and the tapered part 66 define a pivot with upper and lower stops to allow limited upward and downward pivoting of the dowel 58 relative to the dowel sleeve 60. The dowel 58 may be formed from corrosion-free material such as, for example, polymer material. The sleeve 60 may be adapted to clip on to a sideform 20 for forming adjacent concrete panels 68. Accordingly, there is shown a concrete pathway formwork system including a sideform 20 for forming adjacent concrete panels 68 of a pathway, a dowel 58 adapted to extend through the sideform 20 for transferring load between the adjacent concrete panels 68, and a sleeve 60 for receiving the dowel 58, wherein the dowel 58 is arranged to pivot upwardly and/or downwardly relative to the sleeve 60. With reference to FIG. 10, the concrete pathway formwork system may include a seal 70 fitted to the sideform 20, the seal 70 having an aperture 72 through which a tongue 74 of the dowel 58 is inserted such that the seal 70 operates to seal between the dowel 58 and the sideform 20 against concrete ingress.

It should be appreciated that various embodiments of the present disclosure provide one or more of the following features or advantages:

- Corrosion-free articulating dowel system that allows for deflection control on light duty concrete pavements when joint articulates due to tree roots or reactive soil.
- Allowing up to 50 mm of simultaneous vertical lift on slabs while maintaining deflection control, load transfer, lateral dowel movement and expansion capabilities.
- CAM component of dowel allowing dowel rotation while carrying load horizontally across joint.
- A fastener-less pivoting clip on function of system to extruded formwork.
- Resisting sleeve pull down by bracing itself above sleeve body with locked in cantilevered ribs.
- Ribs below the sleeve brace sleeve in compression.
- Surrounds around the clips prevent sleeve dislodgement from top pivoting point.
- Incorporating 5 mm crushable internal lateral movement voids and a 10 mm expansion void.
- Centring ribs protruding into the slot on formwork preventing lateral misalignment of the sleeve with the slot.
- Dowel is kept horizontal during concrete pour by crushable positioning ribs located internally in the sleeve.
- System is sealed off from concrete ingress with an additional seal.

With reference to FIGS. 13 to 17, there is shown a formwork panel 76 for forming adjacent concrete bodies, wherein the formwork panel 76 is adapted to be compressible on expansion of the concrete bodies. The concrete bodies may be in the form of adjacent concrete panels of a pathway or the like.

Figure 14:
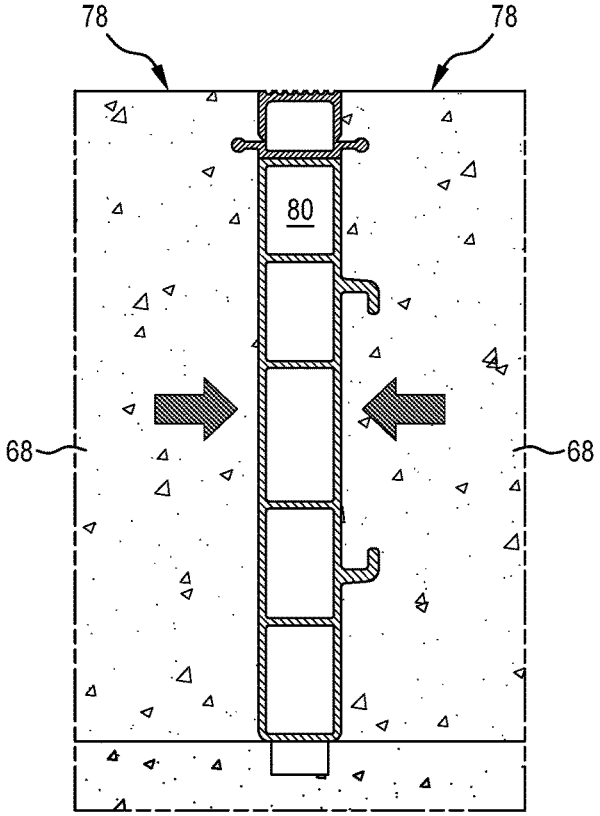
FIG. 14 shows a cross-sectional view of the multi-functional formwork panel of FIG. 13.
Figure 15:
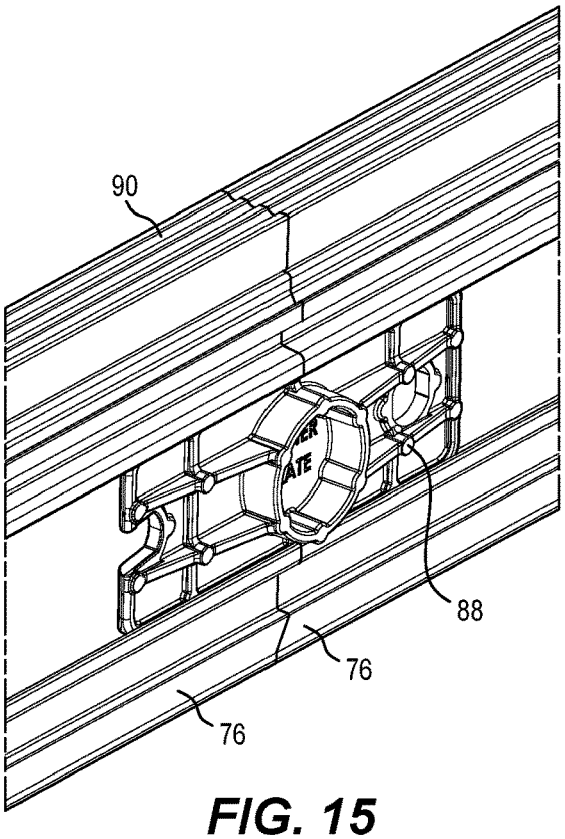
FIG. 15 shows two multi-functional formwork panels of FIG. 13 connected together.

The formwork panel 76 may be substantially planar to be in a plane substantially perpendicular to a travel surface formed by upper surfaces of the concrete bodies. For example, as shown in FIG. 14, the concrete bodies 68 have upper surfaces 78 and the formwork panel 76 is substantially perpendicular to a travel surface (e.g., pathway) formed by the upper surfaces 78. The planar nature of the formwork panel 76 is in contrast to existing formwork that has a cross-sectional shape in the form of an inverted T.

Figure 17:
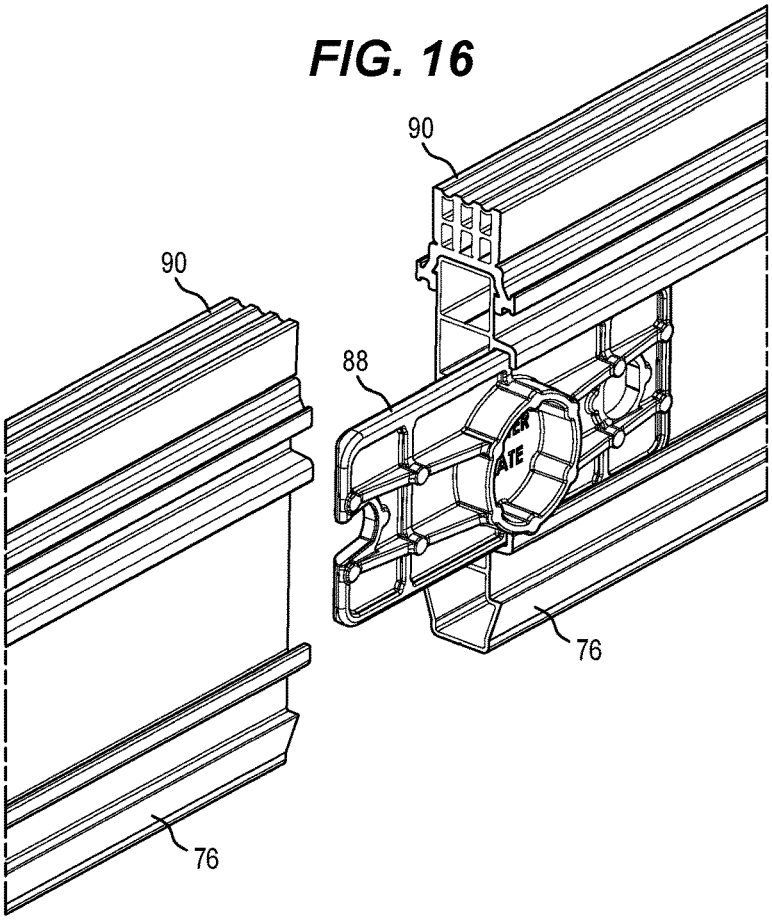
FIG. 17 shows joining of two multi-functional formwork panels of FIG. 13.

The formwork panel 76 may be extruded with a constant cross-sectional shape along its length such that the formwork panel 76 is able to be cut to length so as to suit a particular application. The formwork panel 76 has at least one internal void 80 to facilitate sacrificial compression of the formwork panel 76 on expansion of the concrete bodies 68. The formwork panel 76 has a pair of opposed sideform walls 82 connected by at least one sacrificial rib 84 defining an internal void 80 between the opposed sideform walls 82. The formwork panel 76 has a pair of opposed rails 86 along at least one side of the formwork panel 76, the opposed rails 86 defining a channel for slideable mounting of an accessory to the formwork panel 76. The channel enables the formwork panel 76 to be connected to another like formwork panel 76 (such as seen in FIG. 17) by inserting one end of a joiner plate 88 in the channel of the formwork panel 76 and an opposite end of the joiner plate in the channel of the like formwork panel 76.

It should be appreciated that various embodiments of the present disclosure provide one or more of the following features or advantages:

- Compressible extruded sacrificial formwork panel and capping.
- Crushable up to 10 mm to allow for thermal expansion at joint.
- Multi-functional utility channel that allows for components to be attached continuously along the length.
- Retaining function as an expansion joint and functionally of components when cut.
- Panels can be joined with joiner plate at any point when cut.

Figure 16:
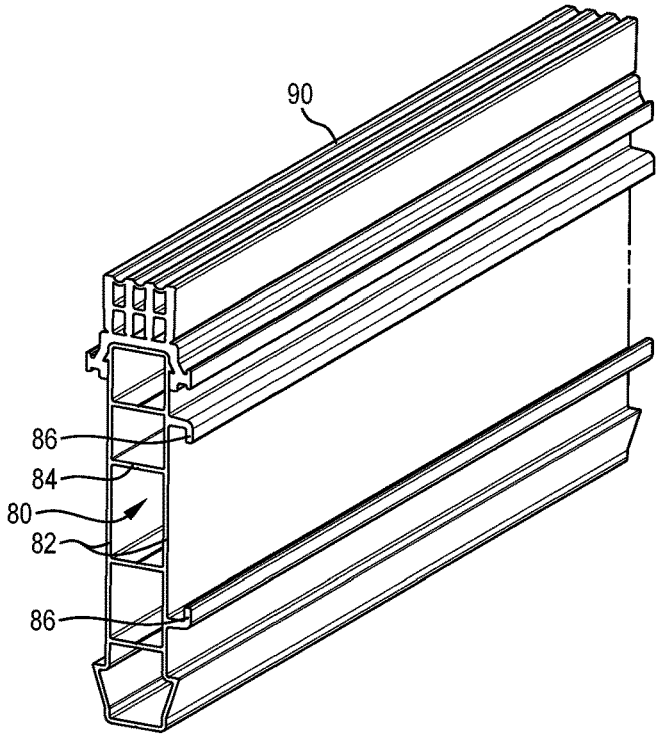
FIG. 16 shows a multi-functional formwork panel of FIG. 13 having a capping installed thereon in accordance with the present disclosure.
Figure 18:
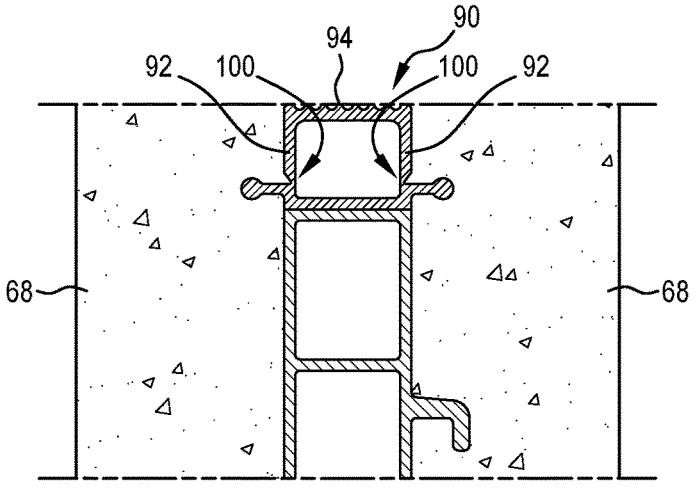
FIG. 18 shows a Rip-A-Strip sealant well capping in place in accordance with the present disclosure.

The formwork panel 76 may also have an upper capping 90, the capping 90 having side walls 92 and a top surface 94 arranged to be level with the upper surfaces 78 of the concrete bodies 68, as shown in FIG. 18. The capping 90 may be adhered to a top of the formwork panel 76 as shown in FIGS. 18 to 21, or may be resiliently clipped or slid on to a top portion of the formwork panel 76 as shown in FIGS. 16 and 17.

Figure 19:
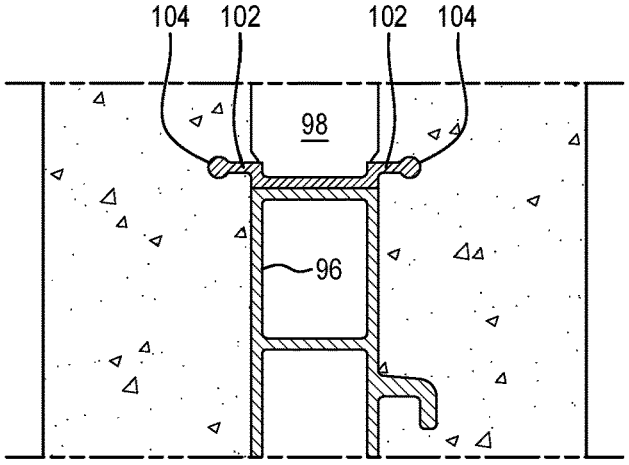
FIG. 19 shows the capping removed to form a well in accordance with the present disclosure.
Figure 20:
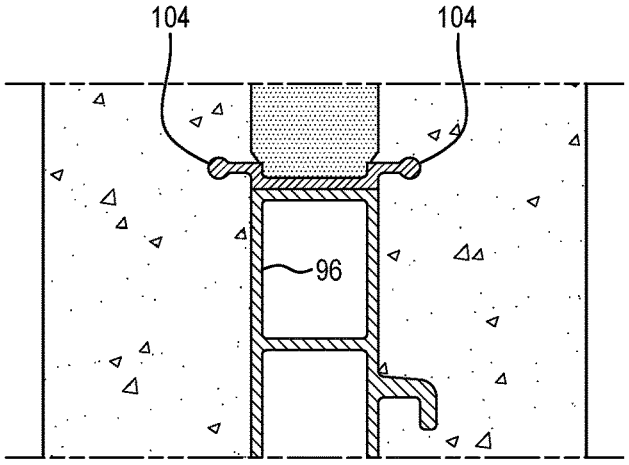
FIG. 20 shows the well filled with material in accordance with the present disclosure.

With reference to FIGS. 18 to 21, there is shown a formwork panel 76 for forming adjacent concrete bodies 68, the formwork panel having a formwork panel body 96 and a formwork panel capping 90 arranged to be selectively moved from a coupled condition (as seen in FIG. 18) in which the formwork panel capping 90 is coupled to the formwork panel body 96 to form a surface level with upper surfaces 78 of the concrete bodies 68 and a decoupled condition (as seen in FIG. 19) in which at least part of the formwork panel capping 90 is decoupled from the formwork panel body 96 so as to form a well 98 between the concrete bodies 68. The well 98 may have a predetermined depth being the height of the capping 90, less a thickness of a floor of the capping 90.

The formwork capping 90 may be formed with a frangible part 100 which is torn to move the formwork panel capping 90 from the coupled condition to the decoupled condition. The frangible part 100 may be located between an upper portion of the capping 90 and a lower portion of the capping 90 such that tearing the frangible part 100 separates the upper portion of the capping 90 from the lower portion of the capping 90. FIG. 18 shows the upper portion and lower portion of the capping 90 connected whereas FIG. 19 shows the upper portion removed from the lower portion. The capping 90 may include opposed arms 102 extending laterally outwardly from opposite sides of the capping 90 such that distal ends of the arms 102 are embedded in the concrete bodies 68. Each of the distal arms 102 may have an enlarged portion 104 to facilitate retainment in the concrete.

Figure 21:
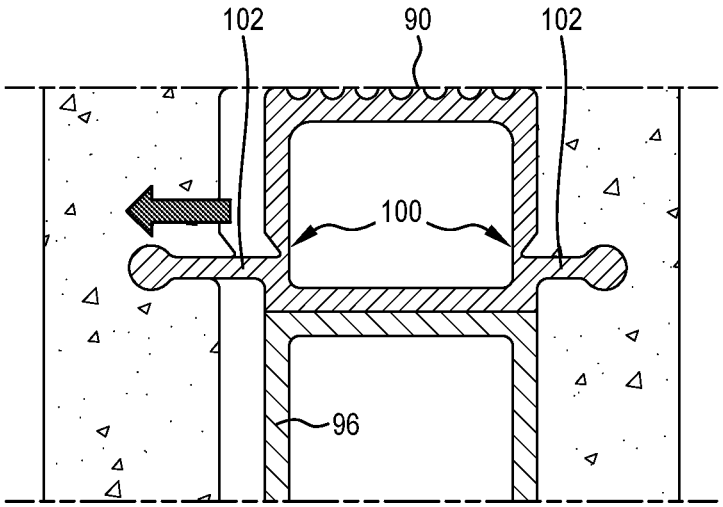
FIG. 21 shows stretching of an arm of the capping in accordance with the present disclosure.
Figure 22:
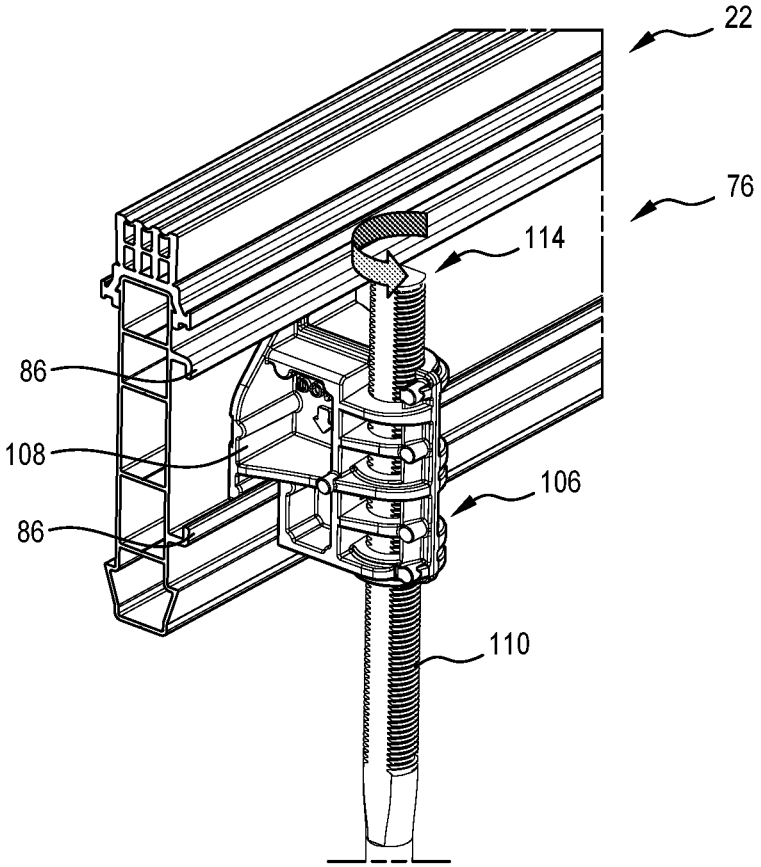
FIG. 22 is a perspective view of a twist and lock stake bracket and stake of one example embodiment of the present disclosure.

The opposed arms 102 may extend outwardly from the lower portion of the capping 90, and the arms 102 may be able to be stretched to accommodate relative outward movement/retraction of the concrete bodies (as seen in FIG. 21). Advantageously, by virtue of the opposed arms 102 being able to stretch in this way, they stretch with joint opening covering the gap preventing epoxies from running down the joint gap and acting as a debris and weed deterrent.

It should be appreciated that various embodiments of the present disclosure provide one or more of the following features or advantages:

- Flexible permanent/removable capping.
- A first option for the capping to remain permanently with joint.
- A second option for the capping to be ripped off joint (once poured) at tear points to allow scrabbling of joint and to create a welled rebate for use of joint sealants.
- Wings on side anchor into concrete (either side).
- Ribs stretch with joint opening covering the gap preventing epoxies from running down joint gap and act as a debris and weed deterrent.

Figure 23:
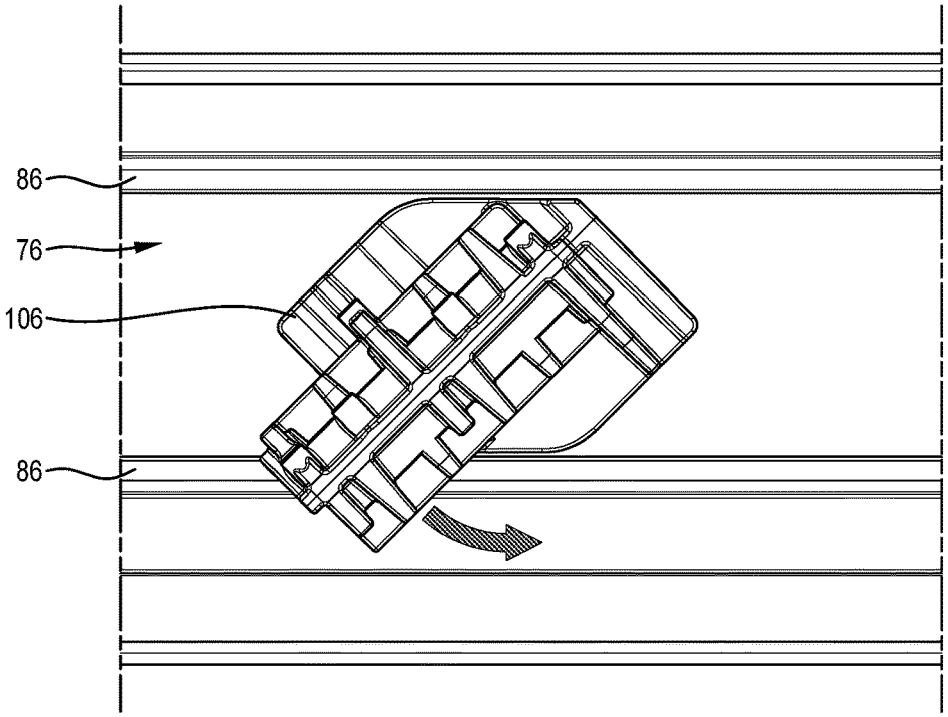
FIG. 23 shows the bracket of FIG. 22 in an unlocked condition.
Figure 24:
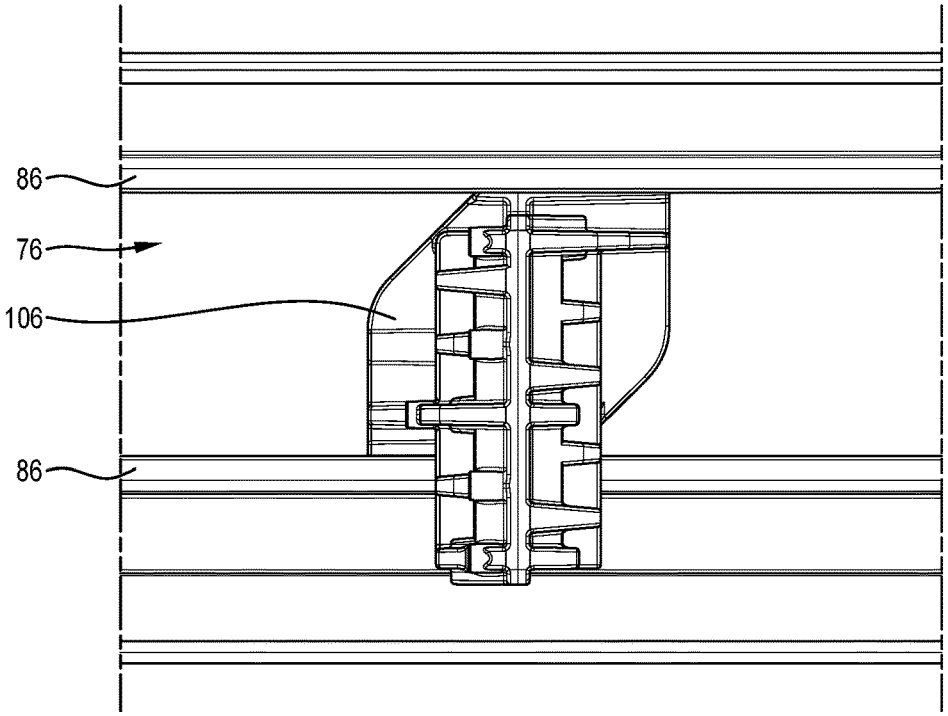
FIG. 24 shows the bracket of FIG. 22 in a locked condition.
Figure 25:
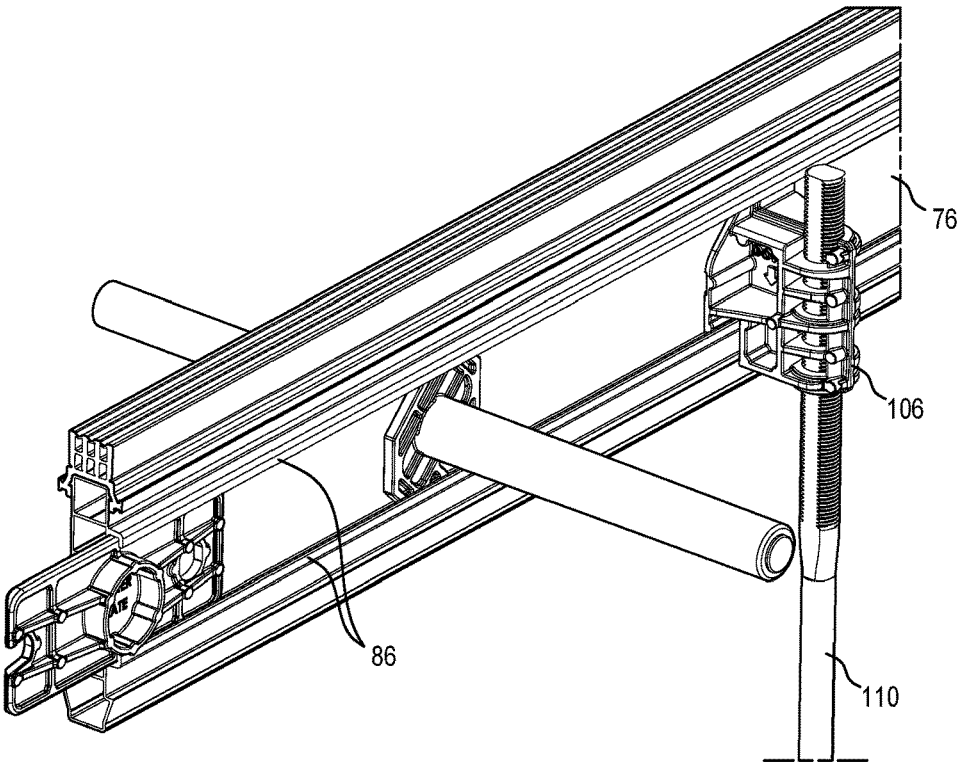
FIG. 25 shows the bracket and stake of FIG. 22 in place on the multi-functional formwork panel.
Figure 26:
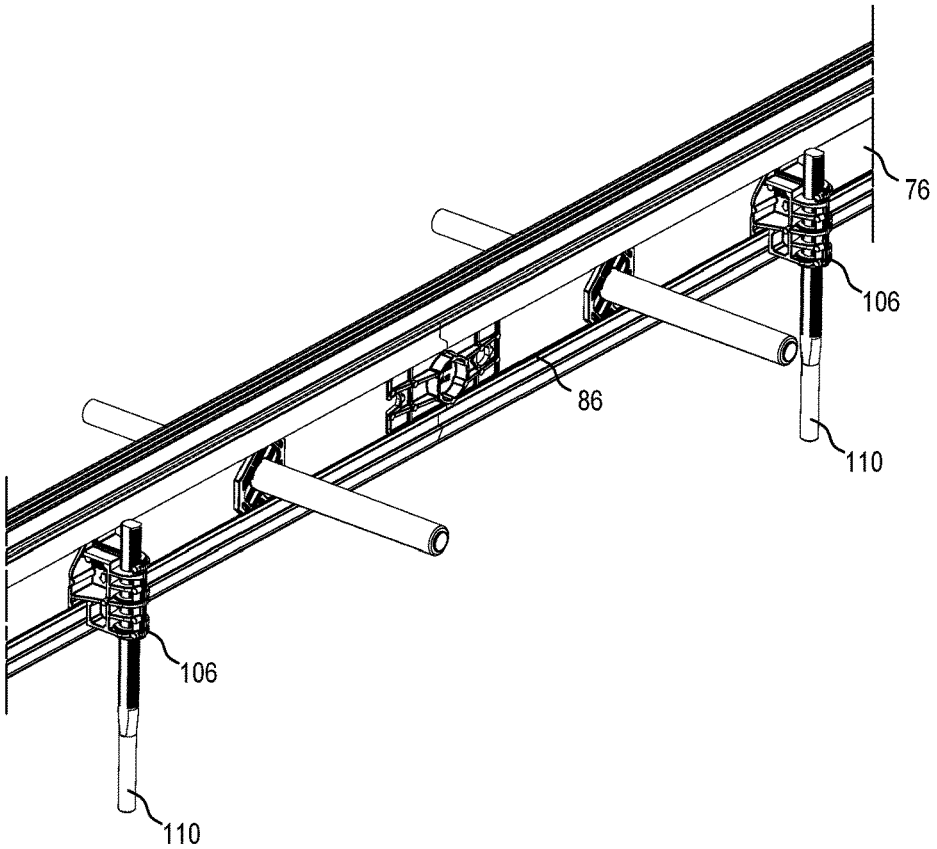
FIG. 26 shows two joined formwork panels of FIG. 13, each having a stake and bracket of FIG. 22 fitted thereto.
Figure 27:
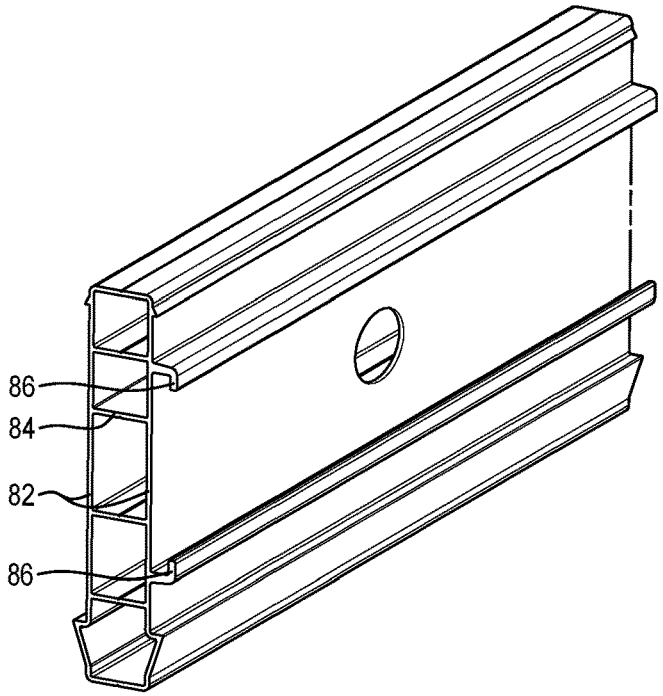
FIG. 27 shows detail of the multi-functional formwork panel of FIG. 22 having opposed rails down one side.

Turning to FIGS. 22 to 28, there is shown a concrete pathway formwork system 22, including a formwork panel 76 for forming adjacent concrete panels of a pathway, and a support bracket 106 for supporting the system 22 relative to a ground surface. The formwork panel 76 has a pair of vertically opposed longitudinal rails 86, and the support bracket 106 has an engagement formation 108 which has an unlocked orientation (as seen in FIG. 23) for inserting the formation 108 between the opposed rails to abut against the formwork panel 76 and a rotated, locked orientation (as seen in FIG. 24) wherein the formation 108 is locked by the rails 86 against lateral withdrawal from the formwork panel 76.

The formation 108 is unlocked from the opposed rails 86 by rotation of the formation 108 about a lateral axis of the system from the locked orientation to the unlocked orientation.

Figure 28:
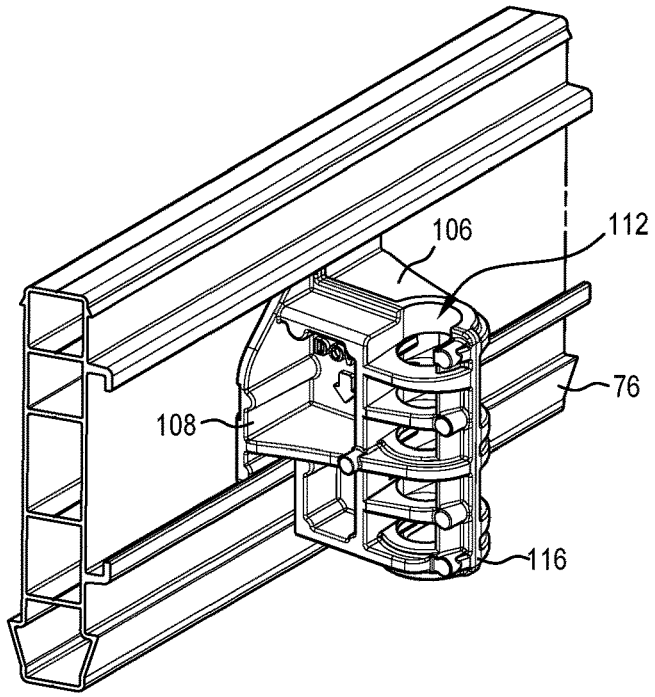
FIG. 28 shows detail of the bracket of FIG. 22 and its attachment to the opposed rails.
Figure 29A:
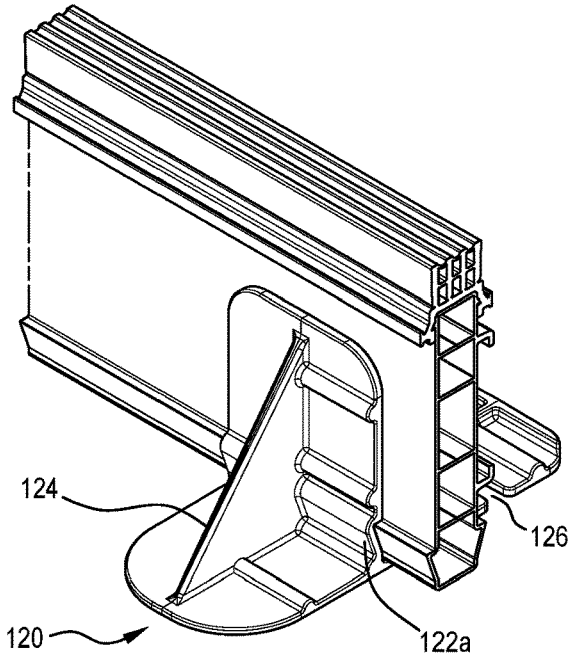
FIGS. 29*a*, 29*b*, 29*c*, and 29*d* show a clip-on foot for supporting the formwork panel of FIG. 13.
Figure 29B:
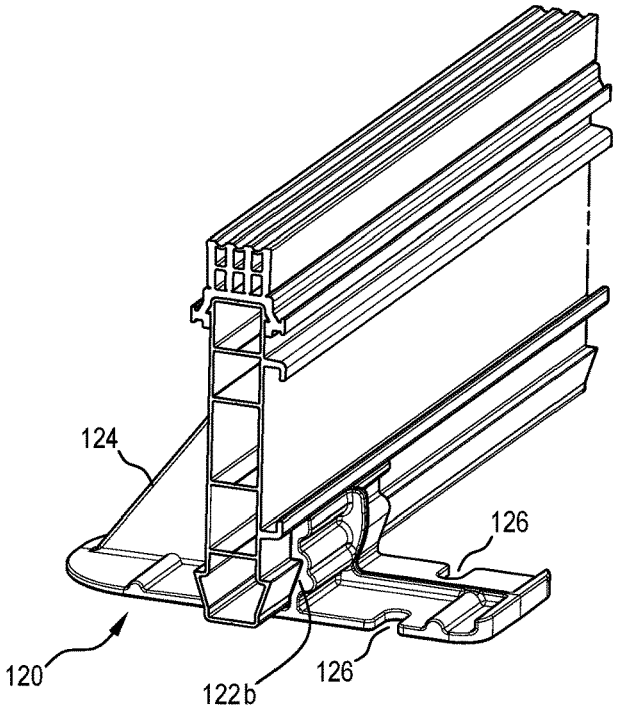
Figure 29C:
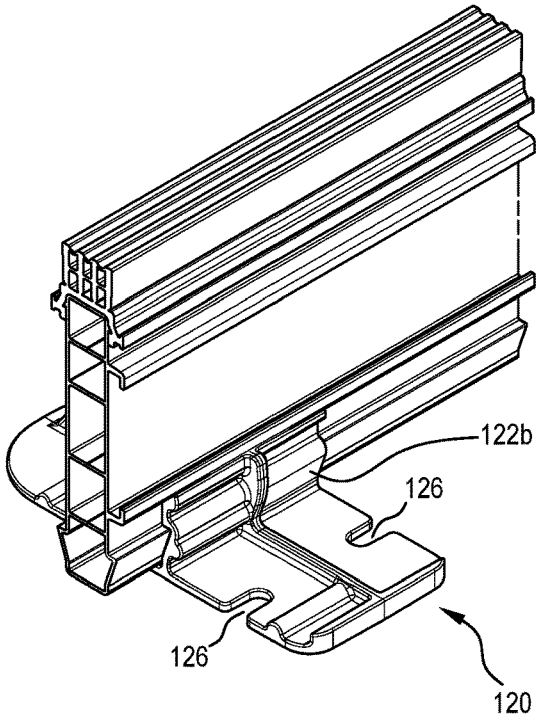
Figure 29D:
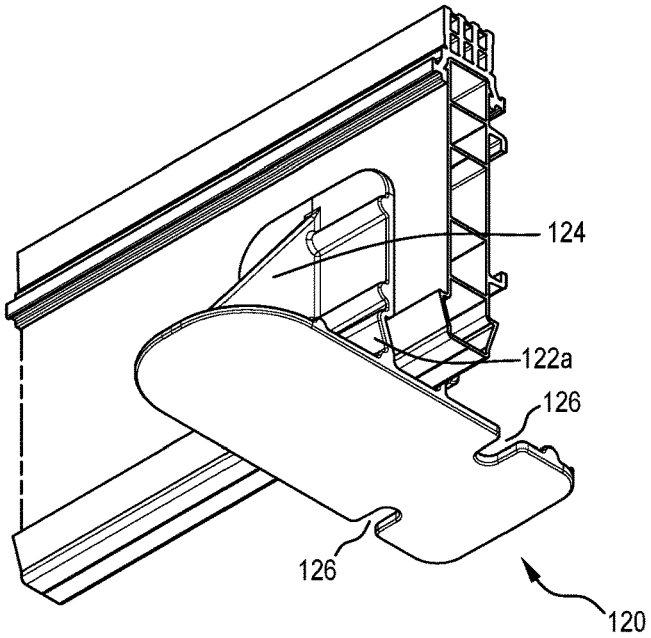

The bracket 106 is supported relative to the ground surface by a stake 110 and the bracket 106 has an aperture 112 (as seen in FIG. 28) for receiving the stake. The stake is threaded (see FIG. 22) and has opposed faces 114, the bracket 106 being formed with rotationally spaced engagement portions such that the stake 110 is able to be freely slid along its longitudinal axis through the bracket 106 and locked by rotating the stake 110 about its longitudinal axis relative to the bracket 106.

As can be seen in FIG. 28, the bracket 106 terminates at a lower end thereof above a lower edge of the formwork panel 76. The formwork panel 76 is formed as a unitary part and has a pair of opposed side walls 82 formed integrally with at least one rib 84, the opposed side walls 82 defining a void 80 therebetween. In the example shown in FIG. 27, the formwork panel 76 has six such ribs 84, comprising two external ribs and four internal ribs. The bracket 106 may itself be formed as a unitary part and may have a central rib 116 extending along the length of the bracket 106.

FIGS. 29*a* to 29*d* show a clip-on foot 120 for supporting the formwork panel 76. In particular, there is provided a clip-on foot 120 having a portion 122*a* and 122*b* for clipping on to a bottom tapered rail of the formwork panel 76. The portion for clipping on to the bottom tapered rail is formed of long upright support 122*a* and a short upright support 122*b*. The long upright support 122*a* has a strengthening brace 124 extending from the long upright support 122*a* downwardly and outwardly to be supported along a horizontal foot portion of the clip-on foot 120. The horizontal foot portion also has a pair of opposed notches 126 for soil nailing of the formwork profile using pins. Advantageously, the clip-on foot 120 enables the formwork profile to be freestanding, with multiple (for example three or four) clip-on feet to be fitted along a span of the formwork. The clip-on foot 120 enables the formwork to be moved to a final position, with the notches 126 being used for pinning the formwork panel 76 in position directly in the soil.

It should be appreciated that various embodiments of the present disclosure provide one or more of the following features or advantages:

- Formwork bracing and height adjustment system.
- Attached to any point of the formwork panel utility channel with a twist and lock CAM base.
- Inserted and turned 45 degrees to lock.
- Fastener-less attachment process is quick and intuitive.
- Central rib-based shape provides additional anchorage of the joint in one slab (pour through).
- Removable and reusable before second pour (stop pour).
- Twist and lock stake lock off.

It should also be appreciated that various embodiments of the present disclosure provide one or more of the following features or advantages:

- Application: Concrete Pavements for pathways (such as but not limited to Footpaths, Bikeways, etc) such as for pedestrian and light vehicular traffic in urban residential areas, parklands, commercial (retail) public spaces and civil infrastructure.
- The system has been configured to satisfy the requirements of Australian Standard: AS 3727.1:2016 Residential Pavements
- A modular solution, with the capability to cast a range of slab thicknesses 75 mm, 100 mm, 125 mm & 150 mm. Modular sections are joinable to cast pavements up to (and greater than) 4 m in width.
- A self-supporting configuration, that is economical to freight, and is easily assembled on site.
- The solution must be non-corrosive for use in bayside applications or decorative pavement streetscapes.
- A system that must provide for thermal expansion and contraction to a maximum joint gap thickness of 10 mm.
- A joint system that minimizes the impact of pavement slab heaving caused by (1) Tree Roots or (2) Reactive Soil.
- A joint system that controls deflection under the conditions slab heaving caused by: (1) Tree Roots or (2) Reactive Soil While various embodiments of the present disclosure have been described above, it should be understood that they have been presented by way of example only, and not by way of limitation. It will be apparent to a person skilled in the relevant art that various changes in form and detail can be made therein without departing from the spirit and scope of the present disclosure. Thus, the present disclosure should not be limited by any of the above described exemplary embodiments.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The claims defining the invention are as follows:

1. A concrete formwork system for forming adjacent concrete panels on a ground surface, said concrete formwork system comprising:

- a formwork panel including a pair of longitudinally extending spaced-apart vertically opposed rails;
- a threaded stake having opposed faces; and
- a support bracket including an engagement formation insertable between the opposed rails when in an unlocked orientation and thereafter rotatable to a locked orientation relative to the opposed rails such that the engagement formation is locked by the opposed rails against lateral withdrawal from the formwork panel, the support bracket defining an aperture configured to receive the stake, the support bracket including rotationally spaced-apart engagement portions such that the stake is able to be freely slid through the aperture in the support bracket and is lockable in the aperture of the support bracket by rotation of the stake about a longitudinal axis of the stake relative to the support bracket, the support bracket including a locking rib configured to engage the stake to prevent movement of the stake along a longitudinal axis of the aperture.

2. The concrete formwork system of claim 1, wherein when the engagement formation is in the locked orientation, the engagement formation is unlockable from the opposed rails by rotation of the engagement formation about a lateral axis.

3. The concrete formwork system of claim 1, wherein the support bracket terminates above a lower edge of the formwork panel when the engagement formation is in the locked orientation relative to the opposed rails of the formwork panel.

4. The concrete formwork system of claim 1, wherein the formwork panel is formed as a unitary part.

5. The concrete formwork system of claim 1, wherein the formwork panel includes a pair of longitudinally extending opposed sidewalls, the opposed sidewalls defining a void therebetween.

6. The concrete formwork system of claim 1, wherein the support bracket is formed as a unitary part.

7. A concrete formwork system for forming adjacent concrete panels on a ground surface, said concrete formwork system comprising:

- a formwork panel including a pair of longitudinally extending opposed sidewalls and a pair of longitudinally extending spaced-apart vertically opposed rails laterally extending from one of the side walls;
- a stake engageable with the ground surface; and
- a support bracket including an engagement formation insertable between the opposed rails and lockable by the opposed rails such that the engagement formation is locked by the opposed rails against lateral withdrawal from the formwork panel, the support bracket defining an aperture configured to receive the stake, the support bracket including a locking rib extending into the aperture and engagable with the stake such that in a first rotational position relative to the aperture, the stake can move through the aperture without engaging the locking rib, and in a different second rotational position relative to the aperture, the locking rib engages the stake to prevent the stake from moving in the aperture.

8. The concrete formwork system of claim 7, wherein the pair of opposed sidewalls define a void therebetween.

9. The concrete formwork system of claim 7, wherein the stake is threaded.

10. The concrete formwork system of claim 9, wherein the stake has opposed threaded faces and the stake has opposed non-threaded faces.

11. The concrete formwork system of claim 7, wherein the support bracket terminates above a lower edge of the formwork panel when the engagement formation is locked by the opposed rails of the formwork panel.

12. The concrete formwork system of claim 7, wherein the formwork panel is formed as a unitary part.

13. The concrete formwork system of claim 7, wherein the support bracket is formed as a unitary part.

14. A concrete formwork system for forming adjacent concrete panels on a ground surface, said concrete formwork system comprising:

a formwork panel including first and second longitudinally extending spaced-apart vertically opposed rails;

a stake having opposing threaded faces and opposing non-threaded faces; and a support bracket including an engagement formation having a first edge, a second edge, a third edge, and a fourth edge, the engagement formation insertable between the first and second opposed rails such that the first edge is adjacent to the first rail and the second edge is adjacent to the second rail, and thereafter rotatable to a locked orientation relative to the first and second opposed rails wherein the third edge engages and is held by the first rail and wherein the fourth edge engages and is held by the second rail, the support bracket defining an aperture configured to receive the stake, the support bracket including a locking rib configured to engage one of the threaded faces of the stake to prevent movement of the stake along a longitudinal axis of the aperture.

15. The concrete formwork system of claim 14, wherein the support bracket terminates above a lower edge of the formwork panel when the engagement formation is in the locked orientation relative to the opposed rails of the formwork panel.

16. The concrete formwork system of claim 14, wherein the first edge and the third edge extend at an obtuse angle relative to each other and wherein the second edge and the fourth edge extend at an obtuse angle relative to each other.

* * * * *